US005912613A

United States Patent [19]

Kotani et al.

[11] Patent Number: 5,912,613

[45] Date of Patent: Jun. 15, 1999

[54] HIGH-VOLTAGE RESISTOR UNIT AND HIGH-VOLTAGE VARIABLE RESISTOR UNIT

[75] Inventors: Hirokazu Kotani, Yatsuo-machi; Motoharu Higami, Shimo-mura; Shinichi Kamata, Yatsuo-machi; Susumu Harada, Tonami, all of Japan

[73] Assignee: Hokuriku Electric Industry Co., Ltd., Toyama Pref., Japan

[21] Appl. No.: 08/761,330

[22] Filed: Dec. 10, 1996

[30] Foreign Application Priority Data

Dec. 28, 1995 [JP] Japan ..... 7-343442

[51] Int. Cl.[6] ..... H01C 10/32

[52] U.S. Cl. ..... 338/160; 338/162; 338/118

[58] Field of Search ..... 338/160, 162, 338/118, 176, 220, 221, 312, 322, 327, 332, 276, 232, 234, 235, 236

[56] References Cited

U.S. PATENT DOCUMENTS

| | | | |
|---|---|---|---|
| 2,169,594 | 8/1939 | Schellenger | 29/620 |
| 4,015,231 | 3/1977 | Seno et al. | 338/174 |
| 4,087,779 | 5/1978 | Oka | 338/327 |
| 4,095,209 | 6/1978 | Wiswell et al. | 338/174 |
| 4,527,147 | 7/1985 | Arakawa | 338/162 |
| 4,632,512 | 12/1986 | Hishiki et al. | 338/48 |
| 4,719,317 | 1/1988 | Reynolds et al. | 174/94 R |
| 4,994,782 | 2/1991 | Watanabe et al. | 338/160 |
| 5,508,678 | 4/1996 | Tsunezawa et al. . | |
| 5,525,956 | 6/1996 | Hashizume et al. | 338/322 |
| 5,546,280 | 8/1996 | Hasebe et al. . | |
| 5,631,623 | 5/1997 | Yoshimura | 338/142 |

FOREIGN PATENT DOCUMENTS

| | | |
|---|---|---|
| 63-203063 | 8/1988 | Japan . |
| 7-27614 | 6/1995 | Japan . |
| 7-235402 | 9/1995 | Japan . |
| 8-31619 | 2/1996 | Japan . |
| 8-97017 | 4/1996 | Japan . |

OTHER PUBLICATIONS

JP 8–31619 translation, Feb. 1996.

*Primary Examiner*—Renee S. Luebke
*Assistant Examiner*—Karl Easthom
*Attorney, Agent, or Firm*—Pearne, Gordon, McCoy & Granger LLP

[57] ABSTRACT

A high-voltage resistor unit capable of minimizing a variation in output voltage thereof. The resistor unit includes an output terminal member provided with a contact section connected, by only contacting, to an output electrode formed on a front surface of a circuit board. The electrode contacted with the constant section of the terminal member has a surface section covered with a resistive paint layer, of which a resistance value in a thickness direction thereof is set to be smaller than a resistance value of a resistance circuit pattern formed on the front surface of the circuit board which resistance value is determined in a thickness direction thereof.

5 Claims, 3 Drawing Sheets

HIGH-VOLTAGE RESISTOR UNIT AND HIGH-VOLTAGE VARIABLE RESISTOR UNIT

BACKGROUND OF THE INVENTION

This invention relates to a high-voltage resistor unit and a high-voltage variable resistor unit, and more particularly to a high-voltage variable resistor unit called a focusing pack which is used for adjusting a focusing voltage, a screen voltage or the like in a cathode ray tube (CRT) or the like.

A high-voltage variable resistor unit which is a typical example of a high-voltage resistor unit is generally put to use while being mounted on a transformer casing of a fly-back transformer and is constructed so as to output at least one of a screen voltage and a focusing pack. There has been recently proposed a high-voltage variable resistor unit called a double-focusing type which is adapted to generate a plurality of focusing voltages and more specifically two kinds of focusing voltages. The conventional high-voltage variable resistor unit is generally classified into a type of generating only a focusing voltage, that of generating both a focusing voltage and a screen voltage, and the like. Such a conventional high-voltage variable resistor unit includes a capacitor called a dynamic focusing capacitor for cutting a DC component and that for a filter, which may be often connected in parallel between an output electrode for a focusing voltage and a ground electrode and between the output electrode and a signal input terminal. The high-voltage variable resistor unit is combined with a fly-back transformer, so that the capacitors are arranged on a rear surface side of a circuit board arranged in an insulating casing which is open at one end thereof. Such arrangement of the capacitors on the rear surface side of the circuit board causes a terminal fitment electrically connected to the output electrode for a focusing voltage for connection of a lead wire of each of the capacitors thereto to be likewise arranged on the rear surface side of the circuit board. In the prior art, the terminal fitment generally has a lead wire connected thereto for outputting the focusing voltage in addition to the lead wire of the capacitor, resulting in the focusing voltage being outputted.

In order to facilitate the connection, a structure is proposed wherein a terminal member including a contact section adapted to be electrically connected to an output electrode by only contacting with the output electrode and without soldering is arranged between a front surface of the circuit board and the insulating casing, resulting in a connection conductor being connected to the terminal member without soldering. Also, another structure is proposed which is so constructed that electrical connection to both the ground electrode and an input electrode is carried out by means of a terminal member and without soldering. In the prior art, a front surface section of the output electrode with which the contact section of the terminal member is contacted is covered with a resistive paint layer formed by printing while having a part of a resistive circuit pattern superposed thereon. Then, the contact section of the terminal member is contacted with the resistive paint layer.

The above-described construction wherein the contact section of the terminal member is contacted through the resistive paint layer with the output electrode causes a resistance of the resistive paint layer in a thickness direction thereof to exist between the output electrode and the contact section. However, a study by the inventors revealed that connection of the capacitor for cutting the DC component between the output electrode and the signal input terminal for the purpose of inputting a dynamic focusing signal of a parabolic shape to the signal input terminal often causes a current in a relatively large amount to flow through the output electrode and signal input terminal. Also, it was found that a current is caused to flow in a relatively large amount to other output electrodes and the ground electrode through the contact section of the terminal member.

In such an instance, an increase in resistance of the resistive paint layer in the thickness direction thereof causes an increase in current flowing between the contact terminal of the terminal member and the electrodes, leading to an increase in heat generation therefrom. The heat thus generated results in a variation in resistance of the high-voltage variable resistor unit, so that an output voltage thereof is varied.

SUMMARY OF THE INVENTION

The present invention has been made in view of the foregoing disadvantage of the prior art.

Accordingly, it is an object of the present invention to provide a high-voltage resistor unit which is capable of reducing resistance loss of a resistive paint layer caused by a current flowing between a terminal member and an electrode.

It is another object of the present invention to provide a high-voltage resistor unit which is capable of preventing a variation in resistance value due to heat generation caused by resistance loss of a resistive paint layer, to thereby eliminate disadvantages such as a variation in output voltage of the resistor unit and the like.

It is a further object of the present invention to provide a high-voltage variable resistor unit which is capable of reducing resistance loss of a resistive paint layer caused by a current flowing between a terminal member and an electrode.

It is still another object of the present invention to provide a high-voltage variable resistor unit which is capable of preventing a variation in resistance value due to heat generation caused by resistance loss of a resistive paint layer, to thereby eliminate disadvantages such as a variation in output voltage of the resistor unit or the like.

In accordance with the present invention, a high-voltage resistor unit is provided which generally includes a circuit board having a front surface, a resistance circuit pattern formed on the front surface of the circuit board and a plurality of electrodes formed on the front surface of the circuit board and connected to the resistance circuit pattern, an insulating casing in which the circuit board is received, terminal members arranged between the front surface of the circuit board and the insulating casing and each including a contact section electrically connected to each of the electrodes by only contacting therebetween and without soldering, and a resistive paint layer arranged so as to cover a surface section of the electrodes with which the contact sections of the terminal members are contacted. In the present invention thus generally constructed, the resistive paint layer is formed so as to have a resistance value in a thickness direction thereof set to be smaller than a resistance value of the resistance circuit pattern in a thickness direction thereof.

In a preferred embodiment of the present invention, the resistance value of the resistive paint layer in the thickness direction thereof is set at a level which prevents the resistance value of the resistive paint layer from being increased to an unreturnable degree due to resistance loss caused by a current flowing through the electrodes of which the surface section is covered by the resistive paint layer. More specifically, the resistive paint layer is formed so as to prevent flowing of the current which causes a substantial increase in resistance value of the resistive paint layer due to resistance loss occurring in the resistive paint layer.

The present invention may be applied to a high-voltage variable resistor unit which includes a circuit board having a front surface and a rear surface, and a variable resistance circuit pattern formed on the front surface of the circuit board and including a plurality of variable resistance elements and an electrode pattern formed on the front surface of the circuit board and including an input electrode, a ground electrode and a plurality of output electrodes arranged in correspondence to a plurality of the variable resistance elements. In the high-voltage variable resistor unit of this aspect, an insulating casing having an inner surface by which a circuit board receiving chamber for receiving the circuit board therein is defined in the insulating casing is arranged. The insulating casing is provided with an opening which renders the circuit board receiving chamber open at one end thereof. The inner surface of the insulating casing is arranged so as to define a space between the inner surface and the front surface of the circuit board. The high-voltage variable resistor also includes a plurality of slide elements arranged in the space and operated from an outside of the insulating casing, as well as a resistive paint layer arranged so as to cover a surface section of the electrodes with which the contact sections of the terminal members are contacted. The resistive paint layer is formed so as to have a resistance value in a thickness direction thereof set at a level which prevents a resistance value of the resistive paint layer from being substantially increased due to heat generation caused by a current flowing through the electrodes.

Further, the present invention may be applied to a high-voltage variable resistor unit which generally includes a plurality of terminal fitments arranged on a rear surface of a circuit board and each having one connection terminal section connected to selected one of output electrodes on the circuit board and the other connection terminal section positioned on a side of the rear surface of the circuit board, a plurality of capacitors arranged on a side of an opening of the insulating casing and each having one lead terminal connected to one of the terminal fitments and the other lead terminal connected to a predetermined connection terminal, and a plurality of output terminal members arranged between the circuit board and the insulating casing to connect a plurality of the output electrodes to which the capacitors are electrically connected and a plurality of output conductors to each other without soldering. The high-voltage variable resistor unit of this aspect likewise includes a resistive paint layer arranged so as to cover at least a surface section of the output electrodes to which the capacitors are electrically connected. The resistive paint layer is formed of a resistive paste having a resistance value which prevents a resistance value of the resistive paint layer from being substantially increased due to resistance loss caused by a current flowing through the output electrodes.

In the high-voltage variable resistor unit of this aspect of the present invention, a terminal member may be arranged between the circuit board and the insulating casing to connect the ground electrode to a ground terminal without soldering. In this instance, the resistive paint layer for covering a surface section of the ground electrode may be formed of a resistive paste having a resistance value which prevents a resistance value of the resistive paint layer from being substantially increased due to resistance loss caused by a current flowing through the ground electrode. It was found that use of such a terminal member with respect to the ground electrode permits a relatively large amount of current to flow through a contact section of the ground electrode. Such flowing of a current in a relatively large amount through the ground electrode is generally carried out for a short period of time, resulting in adverse affection to the resistor unit being reduced, as compared with that through the output electrode. However, use of the terminal member for a long period of time causes a variation in resistance value of the resistor unit, therefore, it is preferable that such a remedy employed for the output electrode as described above is likewise applied to the ground electrode.

Furthermore, the present invention may be applied to a high-voltage variable resistor unit which generally includes first and second terminal fitments arranged on a rear surface of a circuit board and each having one connection terminal section connected to output electrodes on the circuit board and the other connection terminal section positioned on a side of a rear surface of the circuit board, a first capacitor arranged on the side of the rear surface of the circuit board and having one lead terminal connected to the first terminal fitment and the other lead terminal connected to a first connection terminal electrically connected to a ground electrode, a second capacitor arranged on the side of the rear surface of the circuit board and having one lead terminal connected to the second terminal fitment and the other lead terminal connected to a second connection terminal for input of a signal, first and second output terminal members arranged between a front surface of the circuit board and an insulating casing to connect first and second output electrodes and first and second output conductors to each other without soldering, respectively, and a resistive paint layer arranged so as to cover a surface section of the first and second output electrodes.

In the high-voltage variable resistor unit of this aspect, the resistive paint layer for covering the surface section of the second output electrode to which the second terminal fitment is connected may be formed so as to have a resistance value set at a level which prevents a resistance value of the resistive paint layer in a thickness direction thereof from being increased to an unreturnable degree due to resistance loss caused by a current flowing through the second electrode.

In this instance, the resistive paint layer for covering a surface section of the first output electrode to which the first terminal fitment is connected has a resistance value set at a level which prevents a resistance value of the resistive paint layer in a thickness direction thereof from being increased to an unreturnable degree due to resistance loss caused by a current flowing through the first output electrode.

Also, the high-voltage variable resistor unit of this aspect may include a terminal member arranged between the circuit board and the insulating casing to connect the ground electrode and first connection terminal to each other without soldering, wherein the resistive paint layer for covering a surface section of the ground electrode is preferably formed so as to have a resistance value set at a level which prevents the resistance value of the resistive paint layer from being increased to an unreturnable degree due to resistance loss caused by a current flowing through the ground electrode.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a high-voltage variable resistor unit according to the present invention will be described hereinafter with reference to the accompanying drawings.

Referring to FIGS. 1A to 5, an embodiment of a high-voltage variable resistor unit according to the present invention is illustrated. A high-voltage variable resistor unit of the illustrated embodiment includes an insulating casing 1 made of an insulating resin material such as Noryl (trademark) resin, polybutylene terephthalate or the like and a circuit board 3 made of a ceramic material. The circuit board 3 is formed on a front surface thereof with an electrode pattern including an input electrode E1, first and second output electrodes E2 and E3 for output of a focusing voltage, a third output electrode E6 for output of a screen voltage, a ground electrode E4 and a terminal connection electrode E5. Also, the circuit board 3 is formed on the front surface thereof with a variable resistance circuit pattern including resistance elements R1 and R2 for adjustment of a focusing voltage, a resistance element R3 for adjustment of a screen voltage and other resistance elements, as well as current collecting patterns J1 to J3. The electrode pattern is formed of a silver paint or the like by printing and the variable resistance circuit pattern is formed of a resistive paint by printing. The output electrodes E2 and E3, as shown in FIG. 2A, include contact sections E21 and E31 of a rectangular shape each of which is contacted with a contact terminal section of an output terminal which will be described hereinafter, as well as soldered sections E22 and E32 of a circular shape to each of which one of lead wires of each of capacitors C1 and C2 is connected by soldering, respectively. The output electrode E3 likewise includes a contact section of a rectangular shape. The soldered sections E22 and E32 are formed at a central portion thereof with through-holes H1 and H2 for insertion of a lead wire, respectively. Also, the electrodes E1, E4 and E5 are formed at a central portion thereof with through-holes H3 to H5, respectively. In the illustrated embodiment, the variable resistance circuit pattern is formed in such a manner that a resistive paint is deposited on the contact sections E21 and E31 of the output electrodes E2 and E3 and the output electrode E6 by printing so as to cover a part of the current collecting patterns J1 to J3 of the variable resistance circuit pattern as well as the electrodes, respectively, resulting in providing a resistive paint layer R4 (FIG. 5) for covering each of the contact sections E21 and E31. The current collecting patterns J1 to J3 each are formed of a resistive paint for a variable resistance element. The resistive paint layer R4 is made so as to satisfactorily exhibit both increased resistance to solder flowing and increased resistance to solder, to thereby prevent flowing of solder through the soldered sections E22 and E32.

Figure 2A:
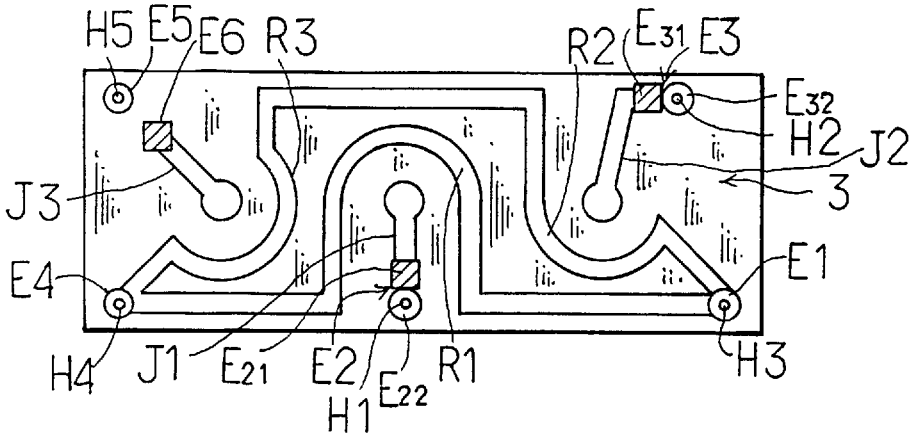
FIG. 2A is a schematic front view showing a front surface of a circuit board.
Figure 2B:
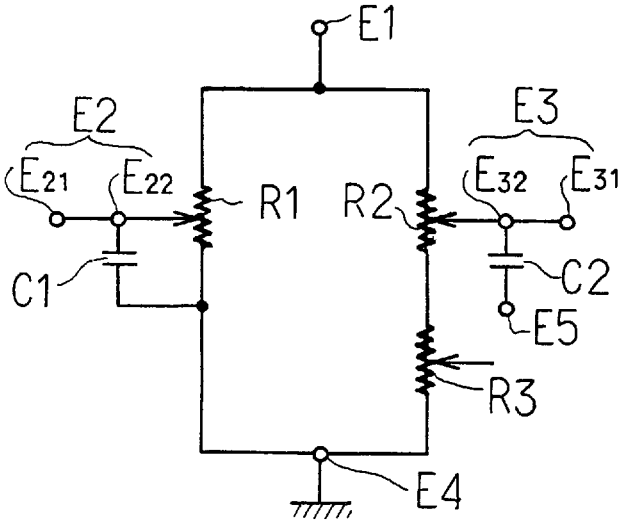
FIG. 2B is a is a circuit diagram showing a circuit incorporated in the high-voltage variable resistor unit of FIG. 1A.
Figure 5:
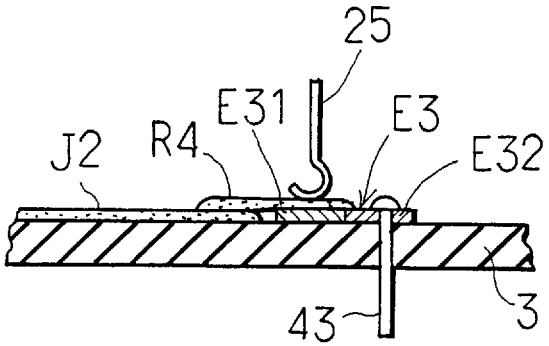
FIG. 5 is a fragmentary sectional view showing an essential part of FIG. 3A.
Figure 3A:
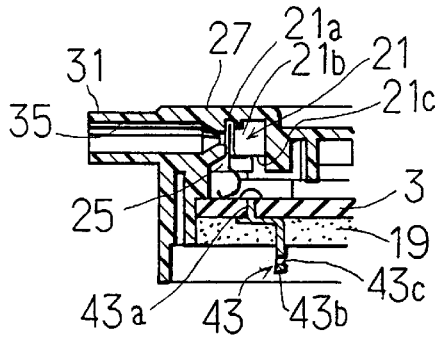
FIG. 3A is a vertical sectional view taken along line IIIA—IIIA of FIG. 1A.
Figure 3B:
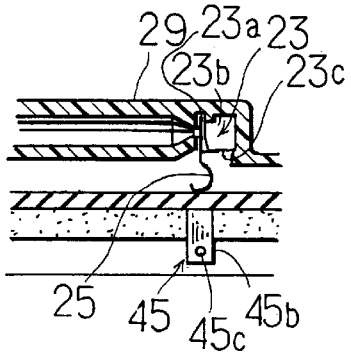
FIG. 3B is a vertical sectional view taken along line IIIB—IIIB of FIG. 1A.

The high-voltage variable resistor unit of the illustrated embodiment, as shown in FIG. 3B, also includes an output terminal member 25, which includes a contact section contacted with the contact section E31 of the output electrode E3 (FIG. 2B) provided on the circuit board 3 in such a manner as shown in FIG. 5.

In FIG. 5, reference numeral 43 designates a terminal fitment 43 having one end arranged so as to extend through the circuit board 3 and soldered to the soldered section E32 of the output electrode E3. The resistive paint layer R4 is arranged so as to cover a surface of the contact section E31 of the electrode E3 while being kept contiguous to the circuit collecting pattern J3 of the variable resistance circuit pattern. The resistive paint layer R4 is so formed that a resistance value thereof in a thickness direction thereof is reduced as compared with that of the resistance circuit pattern R2 in a thickness direction thereof. In the illustrated embodiment, the resistive paint layer R4 is formed of a resistive paint of 1 kΩ/□ in sheet resistivity, resulting in a contact resistance value of the contact section being stabilized at a level of 20Ω or less Also, the resistance value of the resistive paint layer R4 in the thickness direction thereof is set so as not to be increased to an unreturnable degree due to resistance loss caused by a current flowing through the electrode E3. In other words, the resistance value is set at a level which prevents the resistance value from being increased to an unreturnable degree due to the resistance loss. Thus, the resistance value of the resistive paint layer R4 in the thickness direction thereof is set at a level which prevents the resistance value from being substantially damaged due to heat generated therefrom.

More specifically, the resistive paint layer R4 is formed so as to prevent a current which causes a substantial increase in resistance value of the resistive paint layer R4 due to the resistance loss from flowing through the electrode E3.

In the illustrated embodiment, the resistive paint layer R4 for covering the contact section E21 of the output electrode E2 is likewise formed so that a resistance value thereof in a thickness direction thereof is reduced as compared with that of the resistance circuit pattern R2 in a thickness direction thereof.

The insulating casing 1, as shown in FIGS. 3A and 3B, has an inner surface which permits a circuit board receiving chamber for receiving the circuit board 3 therein to be defined in the insulating casing. The inner surface of the insulating casing 1 is formed with two terminal receiving sections 21 and 23. The terminal receiving sections 21 and 23 are fitted therein with first and second output terminal members 25 (FIGS. 3A to 4C) arranged in correspondence to the output electrodes E2 and E3 for a focusing voltage, respectively. In correspondence to the terminal receiving sections 21 and 23, the insulating casing 1 is provided on an upper wall thereof with two expansion sections 27 and 29, as shown in FIGS. 1A, 1B, 3A and 3B. The expansion sections 27 and 29 have cylindrical sections 31 and 32 for insertion of an output conductor such as a lead wire or the like integrally connected thereto, respectively.

The expansion section 27 and cylindrical section 31 and the expansion section 29 and cylindrical section 33 are commonly formed therein with conductor guide passages 35 and 37 for guiding the lead wires or output conductors to the terminal receiving sections 21 and 23, respectively. The lead wire for each of the output conductors includes a core wire and an insulating cover for covering the core wire.

Figure 1A:
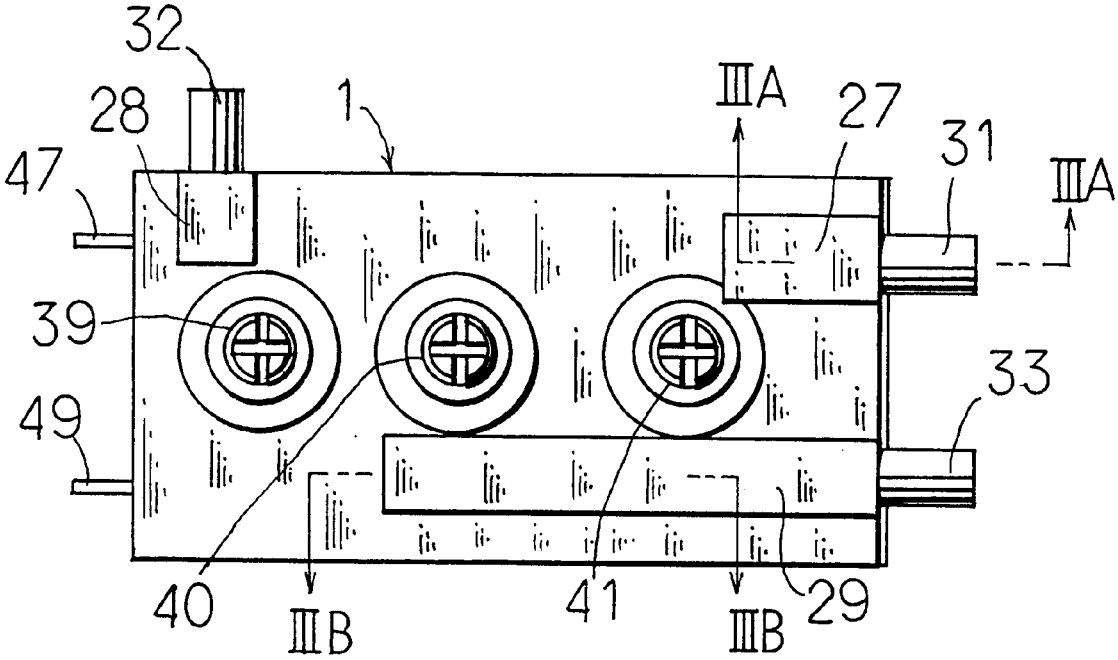
FIG. 1A is a plan view showing an embodiment of a high-voltage variable resistor unit according to the present invention.

Between the inner surface of the insulating casing 1 and the front surface of the circuit board 3 is defined a space in which three slide elements are rotatably received. In FIG. 1A, reference numerals 39 to 41 each designates an operation shaft arranged so as to rotatably extend through an upper wall of the insulating casing 1, resulting in externally operating each of the slide elements. Reference numerals 28 and 32 designate an expansion section and a cylindrical section through which a conductor for output of a screen voltage is inserted, respectively. The expansion section 28 and cylindrical section 32 each may have an internal structure constructed as shown in FIG. 3A.

The terminal receiving sections 21 and 23 shown in FIGS. 3A and 3B may be constructed in substantially the same manner. The terminal receiving sections 21 and 23 include output terminal fit grooves 21*a* and 23*a* arranged so as to communicate with the conductor guide passages 35 and 37 and core wire insertion holes 21*b* and 23*b* arranged so as to communicate with the output terminal fit grooves 21*a* and 23*a*, resulting in the core wires being inserted at a distal end thereof thereinto, respectively. The core wire insertion holes 21*b* and 23*b* each have an opening defined so as to face the circuit board 3. The holes 21*b* and 23*b* are abutted at both side surfaces 21*c* and 23*c* thereof positioned on a side of the opening against a flat section 25*c* of the output terminal member 25 shown in FIGS. 4A to 4C. Such abutment prevents deformation of a plate-like section 25*a* of the output terminal member 25 due to excessive forcing of the output terminal member 25 against each of the fit grooves 21*a* and 23*a*.

Figure 4A:
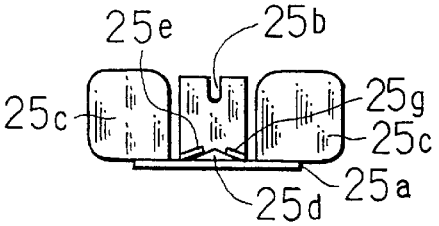
FIG. 4A is a plan view showing an output terminal member.
Figure 4B:
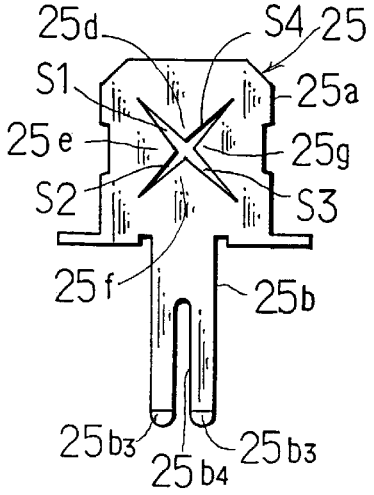
FIG. 4B is a front elevation view of the output terminal member shown in FIG. 4A.
Figure 4C:
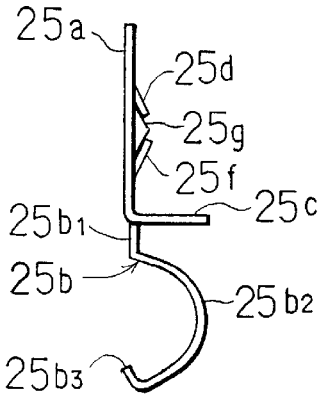
FIG. 4C is a right side elevation view of the output terminal member shown in FIG. 4A.

The output terminal member 25 received in each of the terminal receiving sections 21 and 23 is formed by subjecting a conductive sheet of metal such as stainless steel, bronze or the like to cutting and bending into a predetermined shape, so that a connection conductor may be connected to the output terminal member 25 without soldering. The conductive metal sheet preferably exhibits elasticity to a degree by bending. For this purpose, it may be suitably made of SUS 301 stainless steel of 0.1 to 0.4 mm in thickness, bronze having a thickness of 0.2 to 0.5 mm or the like. The output terminal member 25 may be constructed in such a manner as shown in FIGS. 4A to 4C. More particularly, the output terminal member 25 includes the plate-like section 25*a* formed with a connection conductor holding portion for holding a connection conductor, a contact terminal section 25*b* formed by bending a strip-like portion arranged so as to integrally extend from the plate-like section 25*a*, and the flat section 25*c* having a surface extending in a direction intersecting a surface of the plate-like section 25*a*. The plate-like section 25*a* is formed into a substantially rectangular shape or contour and provided with four slits S1 to S4 in a manner to radially extend from a center thereof to corners thereof. Between the slits S1 to S4 adjacent to each other are defined four triangular edge portions 25*d* to 25*g* which are adapted to bite into an outer peripheral surface of the connection conductor inserted through the plate-like section 25*a*. For this purpose, the edge portions 25*d* to 25*g* are formed so as to be inclined in a direction of insertion of the connection conductor through the plate-like section 25*a* of the output terminal fitment 25. The edge portions 25*d* to 25*g* of the plate-like section 25*a* each are provided with a pointed distal end, resulting in readily biting into the connection conductor, to thereby prevent dislocation of the connection conductor from the output terminal fitment 25 when force in a direction of pulling the connection conductor out of the terminal fitment is applied to the connection conductor.

The contact terminal section 25*b* is formed by bending, resulting in exhibiting elasticity. The contact terminal section 25*b* includes a base portion positioned on a side of the plate-like section 25*a* and including a straight portion 25*b*1. The straight portion 25*b*1 is provided for adjusting the height, therefore, it may be eliminated as desired. Also, the contact terminal section 25*b* includes a curved portion 25*b*2 arranged so as to be contiguous to the straight portion 25*b*1 and a contact portion 25*b*3 formed at a distal end of the curved portion 25*b*2 by curling. The curved portion 25*b*2 is formed with a single slit 25*b*4 so as to extend in a longitudinal direction thereof from the distal end thereof. The slit 25*b*4 is provided for the purpose of finely adjusting elasticity of the curved portion 25*b*2 and providing the contact portion 25*b*3 with a multi-contact function. Also, the elasticity may be adjusted depending on both a width of the slit 25*b*4 and a length thereof. The flat section 25*c* is arranged at an end of the plate-like section 25*a* on a side of the contact terminal section 25*b* in the above-described manner that the surface thereof extends in the direction perpendicular to the surface of the plate-like section 25*a*.

Figure 1B:
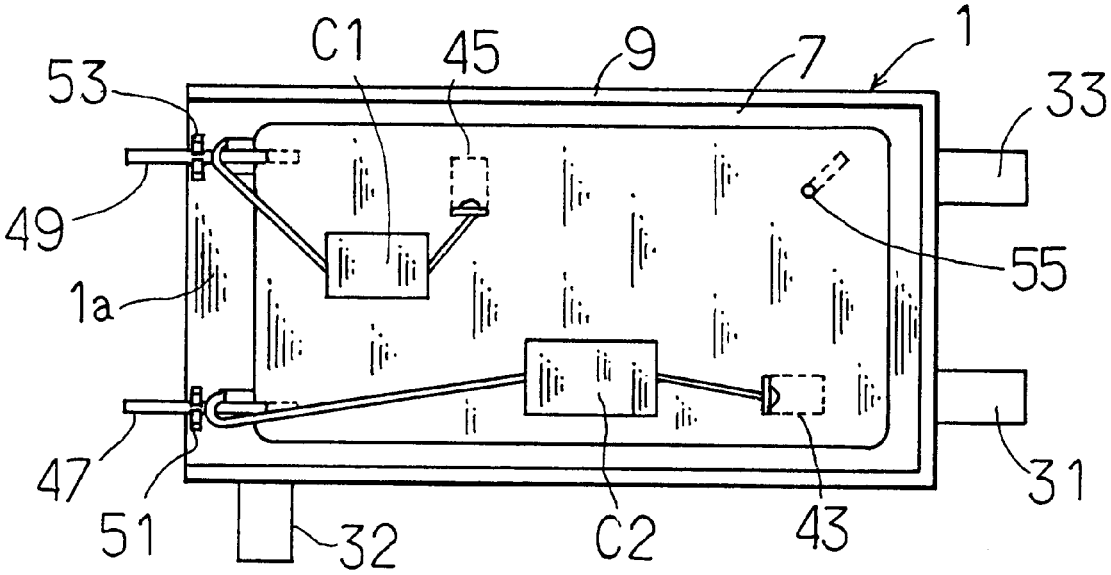
FIG. 1B is a bottom view of the high-voltage variable resistor unit shown in FIG. 1A.

The circuit board 3, as shown in FIGS. 1B, 3A and 3B, is provided on a rear surface thereof with L-shaped terminal fitments 43 and 45. Also, the circuit board 3 is mounted on the rear surface thereof with two connection terminals 47 and 49, which are electrically connected at one end thereof to the ground electrode E4 and connection electrode E5, respectively. In addition, the connection terminals 47 and 49 are arranged so as to extend at the other end thereof through an insulating resin layer 19. Then, the connection terminals 47 and 49 are engaged with at the other end thereof with terminal engagements 51 and 53 integrally provided on a flat section 1*a* of the circuit board 1, respectively. The connection terminals 47 and 49 each may be made by bending a wire-like conductor such as a music wire. Further, the circuit board 3 is mounted thereon with an input terminal 55, which is arranged so as to extend through the circuit board 3 and connected at one end thereof to the input electrode E1 provided on the front surface of the circuit board 3 by soldering. Also, the input terminal 55 is so arranged that the other end thereof extends along the circuit board 3 and in a direction apart from the circuit board 3, resulting in projecting from the insulating resin layer 19. The input terminal 55 may be likewise made by bending a wire-like conductor such as a music wire. The other end of the input terminals 55 is then connected to an output electrode (not shown) provided on a side of a transformer casing of a fly-back transformer.

The terminal fitments 43 and 45 have one connection terminal sections 43*a* and 45*a* arranged so as to extend through the circuit board 3 and connected to the output electrodes E2 and E3 by soldering, respectively. Also, the terminal fitments 43 and 45 have the other terminal sections 43*b* and 45*b* positioned on a side of the rear surface of the circuit board 3 while being kept projecting from the insulating resin layer 19, respectively. In the drawings, the one connection terminal section 43*a* of the terminal fitment 43 is not shown for the sake of brevity. The other connection terminals 43*b* and 45*b* of the terminal fitments 43 and 45 are formed with lead wire insertion holes 43*c* and 45*c*, respectively. The L-shaped terminal fitment 45 positioned in proximity to the connection terminal 49 is so arranged that the lead wire insertion hole 45*c* is open in a direction perpendicular to or across a direction of extension of the connection terminals 47 and 49. The terminal fitment 43 positioned apart from the connection terminals 47 and 49 is so arranged that the lead wire insertion hole 43*c* is open in a direction of extension of the connection terminals 47 and 49. Such arrangement of the terminal fitments 43 and 45 facilitates insertion of the terminal fitments 43 and 45 for the lead wires of the capacitors C1 and C2 into the lead wire insertion holes 43*c* and 45*c*. In particular, the illustrated embodiment is constructed so as to reduce a distance between the terminal fitment 43 and the connection terminal 47, resulting in such arrangement of the terminal fitment 43 as described above facilitates the connection. The capacitors C1 and C2 are connected to the terminal fitment 45 and connection terminal 49 and the terminal fitment 43 and connection terminal 47 by soldering, respectively. The capacitor C1 is arranged for a filter and the capacitor C2 is arranged for cutting of a DC component.

As will be noted from FIGS. 1B and 2B, the capacitor C1 is connected at one lead terminal thereof to the first terminal fitment 45 connected to the first output electrode E2 and at the other lead terminal thereof to the first connection terminal 49 electrically connected to the ground terminal E4. The capacitor C2 is connected at one lead terminal thereof to the second terminal fitment 43 connected to the second output electrode E3 and at the other lead terminal thereof to the second connection terminal 47 for signal input connected to the connection electrode E5. The connection terminal 47 is fed with a signal of a parabolic shape.

Such construction permits a signal current passing through the capacitor C2 to flow from the terminal fitment 43 through the soldered section E32 and contact section E31 of the output electrode E3 on the circuit board 3 and then through the resistive paint layer R4 and output terminal member 25 to an external load. The current causes resistance loss to occur at a portion of the resistive paint layer R4 between the contact section E31 and the output terminal member 25. However, the resistance value of the resistive paint layer R4 in the thickness direction thereof is set as described above, so that the resistance loss may be significantly reduced as compared with the prior art, resulting in preventing a variation in output voltage.

Also, the above-described construction often causes a current in a relatively large amount to flow between the contact section E21 of the output electrode E2 and the output terminal member 25. In order to avoid such a problem, the illustrated embodiment is constructed so as to set the resistance value of the resistive paint layer R4 in the thickness direction thereof at the contact section E21 to a reduced level as described above.

In the illustrated embodiment, the output terminal members 25 without requiring soldering are arranged with respect to only the output electrodes E2 and E3. Alternatively, the input electrode E1 and ground electrode E4 of course may be constructed in substantially the same manner as the output electrodes E2 and E3, wherein an output terminal member like the terminal member 25 is arranged with respect to each of the input electrode E1 and ground electrode E4, to thereby permit the connection conductor or terminal to be electrically connected to each of the electrodes E1 and E4 through the output terminal member without soldering. In this instance, the output terminal member may be provided with a ground terminal section or an input terminal section. The output terminal member may be so constructed that the terminal section is led out of between the circuit board 3 and the insulating casing 1 to a side of the rear surface of the circuit board 3. A study made by the inventors revealed that such construction causes a current in a relatively large amount to flow for a short period of time between the ground electrode and a contact section of the output terminal member. In order to avoid such a disadvantage, a resistive paint layer for covering a contact section of the ground electrode is preferably formed so as to exhibit a resistance value, like the output electrodes E2 and E3. This results in reducing resistance loss due to the ground electrode. Thus, this may be likewise applied to the input electrode.

Although the above description has been made in connection with the high-voltage variable resistor unit including the variable resistance element R3 for screen voltage variation, the present invention may be likewise suitably applied to a high-voltage variable resistor unit of the so-called double-focusing type which does not include any variable resistance element for screen voltage variation.

Also, in the above-described embodiment, the output electrode E6 for output of a screen voltage may be kept exposed because there is not any soldered portion therearound. Alternatively, it may be constructed in substantially the same manner as the output electrodes E2 and E3 for the purpose of preventing migration and the like.

As can be seen from the foregoing, the high-voltage resistor unit of the present invention is so constructed that the resistive paint layer for covering the front surface section of the electrodes on the circuit board has a resistance value in the thickness direction thereof set to be smaller than a resistance value of the resistance circuit pattern in the thickness direction thereof. Such construction reduces resistance loss of the resistive paint layer due to a current flowing between the terminal member and the electrode. Thus, the present invention eliminates a disadvantage that the resistance value is varied by heat generation due to the resistance loss, leading to a variation in output voltage of the unit.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor unit comprising:

a circuit board having a front surface and a rear surface;

a variable resistance circuit pattern formed on said front surface of said circuit board and including a plurality of variable resistance elements and a current collecting pattern formed on said front surface of said circuit board and including an input electrode, a ground electrode and a plurality of output electrodes, each of said output electrodes being electrically connected to one of said plurality of variable resistance elements;

an insulating casing having an inner surface which defines a circuit board receiving chamber, said circuit board receiving chamber receiving said circuit board therein;

said insulating casing defining an opening which renders said circuit board receiving chamber open at one end thereof;

said inner surface of said insulating casing being separated from said front surface of said circuit board so as to define a space therebetween;

a plurality of slide elements arranged in said space and operated from an outside of said insulating casing;

a plurality of terminal fitments disposed on said rear surface of said circuit board and each having one connection terminal section connected to a soldered section of selected one of said output electrodes with soldering and the other connection terminal section positioned on said rear surface of said circuit board;

a plurality of capacitors arranged on a side of said opening of said insulating casing and each having one lead terminal connected to one of said terminal fitments and the other lead terminal connected to a predetermined connection terminal;

a plurality of output terminal members disposed between said circuit board and said insulating casing and connecting said plurality of output electrodes to which said capacitors are electrically connected and a plurality of output conductors to each other without soldering; and a resistive paint layer covering at least a contact surface section of said output electrodes to prevent flowing of solder out of the soldered section;

said resistive paint layer contacting one of said output terminal members and having a resistance value in a direction perpendicular to the front surface of the circuit board which is smaller than a resistance value of said variable resistance elements in said direction perpendicular to the front surface of the circuit board.

2. A high-voltage variable resistor unit as defined in claim 1, further comprising a terminal member between said circuit board and said insulating casing connecting said ground electrode to a ground terminal without soldering;

a further resistive paint layer covering a surface section of said ground electrode, said further resistive paint layer having a resistance value in said direction perpendicular to the front surface of the circuit board which is smaller than the resistance value of said resistance circuit pattern in said direction perpendicular to the front surface of the circuit board.

3. A high-voltage variable resistor unit comprising:

a circuit board having a front surface and a rear surface;

a variable resistance circuit pattern formed on said front surface of said circuit board and including first and second variable resistance elements electrically connected in parallel to each other and a third variable resistance element connected in series to at least one of said first and second variable resistance elements;

a current collecting pattern formed on said front surface of said circuit board and including an input electrode, first, second, and third output electrodes for said first, second, and third variable resistance elements, and a ground electrode;

an insulating casing having an inner surface which defines a circuit board receiving chamber, said circuit board receiving chamber receiving said circuit board therein;

said insulating casing defining an opening which renders said circuit board receiving chamber open at one end thereof;

said inner surface of said insulating casing being separated from said front surface of said circuit board so as to define a space therebetween;

a plurality of slide elements arranged in said space and operated from an outside of said insulating casing;

first and second terminal fitments disposed on said rear surface of said circuit board and each having one connection terminal section connected to a soldered section of one of said first and second output electrodes on said circuit board with soldering and the other connection terminal section positioned on said rear surface of said circuit board;

a first capacitor disposed on said rear surface of said circuit board and having one lead terminal connected to said first terminal fitment and the other lead terminal connected to a first connection terminal electrically connected to said ground electrode;

a second capacitor disposed on said rear surface of said circuit board and having one lead terminal connected to said second terminal fitment and the other lead terminal connected to a second connection terminal for input of a signal;

first, second, and third output terminal members disposed between said front surface of said circuit board and said insulating casing, said output terminal members connecting said first, second, and third output electrodes and first, second, and third output conductors to each other without soldering, respectively; and a resistive paint layer covering a portion of said current collecting pattern and a contact surface section of said first and second output electrodes;

said resistive paint layer contacting said second output terminal member and covering the contact surface section of said second output electrode to which said second terminal fitment is connected having a resistance value in a direction perpendicular to the front surface of the circuit board which is 20Ω or less and is thereby set so as not to be increased to an unreturnable degree due to resistance loss caused by a current flowing through said second output electrode.

4. A high-voltage variable resistor unit as defined in claim 3, wherein said resistive paint layer contacting said first output terminal member and covering the contact surface section of said first output electrode to which said first terminal fitment is connected has a resistance value in said direction perpendicular to the front surface of the circuit board which is 20Ω or less and is thereby set so as not to be increased to an unreturnable degree due to resistance loss caused by a current flowing through said first output electrode.

5. A high-voltage variable resistor unit as defined in claim 3 or 4, further comprising a terminal member arranged between said circuit board and said insulating casing connecting said ground electrode and said first connection terminal to each other without soldering;

a further resistive paint layer covering the surface section of said ground electrode, said further resistive paint layer having a resistance value which is 20Ω or less and is thereby set so as not to be increased to an unreturnable degree due to resistance loss caused by a current flowing through said ground electrode.

* * * * *

UNITED STATES PATENT AND TRADEMARK OFFICE

CERTIFICATE OF CORRECTION

PATENT NO. : 5,912,613
DATED : June 15, 1999
INVENTOR(S) : Kotani et al.

It is certified that error appears in the above-identified patent and that said Letters Patent is hereby corrected as shown below:

On the Title Page, References Cited, U.S. PATENT DOCUMENTS, 6th Reference, delete "4,632,512" and insert --4,631,512--.

Column 5, Line 8, delete "is a is a" and insert --is a--.

Signed and Sealed this

Sixteenth Day of November, 1999

*Attest:*

Q. TODD DICKINSON

*Attesting Officer*

*Acting Commissioner of Patents and Trademarks*